US006056164A

United States Patent [19]

Wakayama

[11] Patent Number: 6,056,164

[45] Date of Patent: May 2, 2000

[54] CONTAINER FOR STENCIL INKS

[75] Inventor: Takahiro Wakayama, Inashiki-gun, Japan

[73] Assignee: Riso Kagaku Corporation, Tokyo, Japan

[21] Appl. No.: 09/154,447

[22] Filed: Sep. 16, 1998

[30] Foreign Application Priority Data

Sep. 22, 1997 [JP] Japan ..... 9-275028

[51] Int. Cl.[7] ..... G01F 11/06

[52] U.S. Cl. ..... 222/327; 222/386

[58] Field of Search ..... 222/327, 386; 141/25, 26, 27; 206/345, 361

[56] References Cited

U.S. PATENT DOCUMENTS

| | | | |
|---|---|---|---|
| 1,238,403 | 8/1917 | Hellein | 141/27 |
| 5,373,969 | 12/1994 | Takemura | 222/386 X |
| 5,566,729 | 10/1996 | Grabenkort et al. | 141/27 X |

*Primary Examiner*—Gregory L. Huson
*Attorney, Agent, or Firm*—Pillsbury Madison & Sutro LLP

[57] ABSTRACT

The present invention provides a cylinder/piston type volume reduction container which does not occupy much space for storage and transportation, and is easy in disposal and recovery. The container comprises a head tubular body (1) an end of which is closed by an end wall (11) having an outlet (12) for content, a rear tubular body (2) which is fitted in the head tubular body and movable in an axial direction of the head tubular body, and a piston member (3) which is fitted in the rear tubular body and movable in an axial direction of the rear tubular body. The rear tubular body may comprise a plurality of tubular bodies nested in telescopic manner. The rear tubular body and the piston may respectively be fitted in the head tubular body and the rear tubular body by way of scraping members (21, 22, 31, 32) provided on an outer peripheral surface of the rear tubular body or the piston. A spacer (25) may be provided protruding from the outer peripheral surface of the rear tubular body toward the inner peripheral surface of the head tubular body.

9 Claims, 3 Drawing Sheets

CONTAINER FOR STENCIL INKS

FIELD OF THE INVENTION

The present invention relates to a cylinder/piston type container in which a liquid or the like is contained, and more particularly relates to a telescopic container which is short in length when no content is filled therein, extends when it is charged with a content, and returns toward the original length as the content is.

BACKGROUND OF THE INVENTION

The recent automated rotary stencil printing machines are constructed so that the ink is sucked up by an ink pump from an ink container loaded removably in the printing machine. The ink container is preferably such that the stencil printing ink of relatively high viscosity contained in the container can be sucked up to the last and can be completely used up. Accordingly, the cylinder/piston type containers are often used which comprise a slender cylinder of about 1–2 mm in wall thickness closed by an end wall at one end having an outlet for the content, a piston member being provided in the cylinder to form a content chamber variable in volume between the end wall and the piston member.

When this cylinder/piston type container is charged with a content, the piston member is first moved to the end wall of the cylinder and then the content is put in the container through the outlet. In this case, the piston member moves backward with charging of the content to expand the content chamber. When the content is taken out, the content is sucked from the outlet by a pump. At this time, the piston member moves toward the end wall to contract the content chamber.

As mentioned above, in the conventional cylinder/piston type containers, the piston member moves with discharging of the content to contract the content chamber, but the size of the cylinder per se of the container does not change. This cylinder generally has an elongated shape and is bulky, and thus is not efficient for transportation of the container, particularly before the container is charged with the content or at the time of disposal or recovery, causing an increase in costs.

SUMMARY OF THE INVENTION

The object of the present invention is to provide a cylinder/piston type container which is small in volume before being charged with a content and does not occupy much space for storage and transportation, increases in volume according to an amount of the content, and reverts to the original volume when the content is completely used, and therefore is easy in disposal and recovery.

According to the present invention, the above object has been attained by a volume reduction container which comprises a head tubular body an end of which is closed by an end wall having an outlet for content, a rear tubular body which is fitted in said head tubular body and movable in an axial direction of said head tubular body, and a piston member which is fitted in said rear tubular body and movable in an axial direction of said rear tubular body.

That is, according to the present invention, the body of the container comprises a head tubular body and a slidable rear tubular body fitted in the head tubular body in the nesting manner, and a piston member is slidably provided in the rear tubular body to form a content chamber. Therefore, depending on the amount of the charged content, not only the size of the content chamber, but also the external size of the container changes. Thus, when no content is contained, the external size is smaller than when a content is contained, and thus a volume reduction container is provided which does not occupy much space for storage and transportation.

DESCRIPTION OF THE INVENTION

Figure 1:
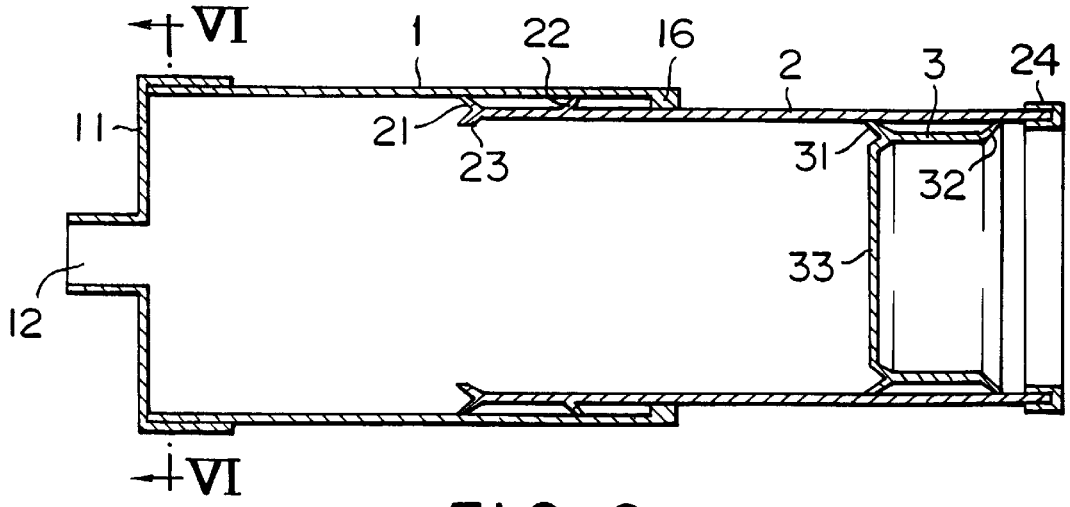
FIG. 1 is a side sectional view in a longitudinal direction of one example of the container of the present invention, showing it in a state of a content being charged in the container.
Figure 2:
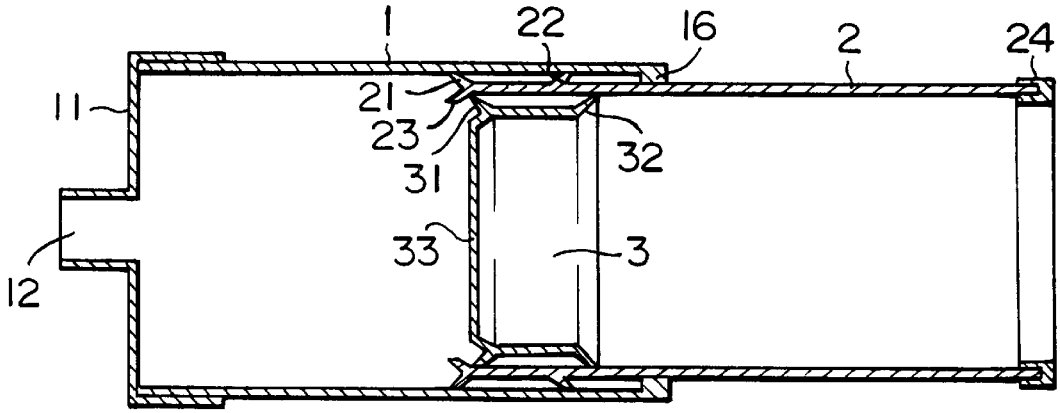
FIG. 2 is a side sectional view in a longitudinal direction of the container of FIG. 1, showing it in a state during the content being discharged.
Figure 3:
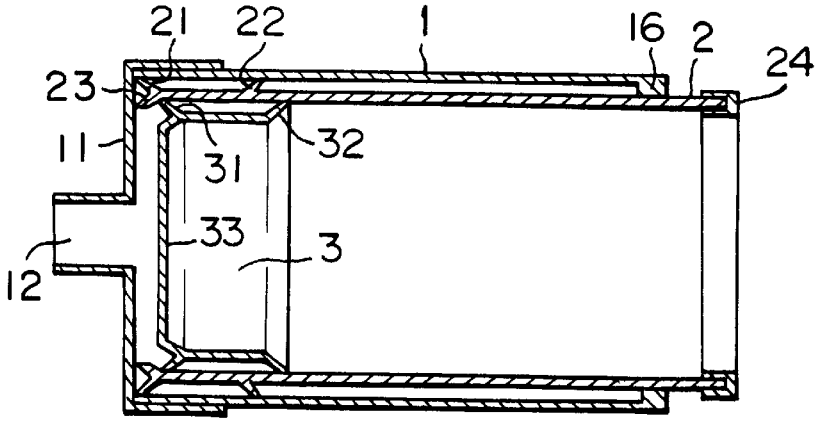
FIG. 3 is a side sectional view in a longitudinal direction of the container of FIG. 1, showing it in a state after the content has been discharged.

FIG. 1 to FIG. 3 are side sectional views in a longitudinal direction of one example of the volume reduction container according to the present invention. This volume reduction container basically comprises a cylindrical head tubular body 1, a cylindrical rear tubular body 2 fitted in the head tubular body 1 in nesting manner, and a cylindrical piston member 3 fitted in the rear tubular body 2 in nesting manner. The head tubular body 1 comprises a cylindrical member which is open at both ends, and a cap member which is provided at one of the ends of the cylindrical member. The cap member has an outlet 12 and an end wall 11. This cap member can be provided by any methods such as screwing and welding, and it may be removable from the cylindrical member. If the end portion of the head tubular body 1 having the cap member is called a front end portion, a claw 16 for preventing the rear tubular body 2 from slipping off is provided at the inner peripheral surface of the rear end portion of the head tubular body 1. The rear tubular body 2 fundamentally comprises a cylinder which is open at both ends thereof and has an outer diameter smaller than the inner diameter of the head tubular body 1, and is provided with a ring-shaped scraping part 21 projecting outwardly from the front end portion and besides provided with another ring-shaped scraping part 22 projecting outwardly from the outer peripheral surface of the rear tubular body and positioned behind the scraping part 21 and at a distance therefrom. Thus, the rear tubular body 2 is slidable in its axial direction and is in contact with the inner peripheral surface of the head tubular body 1 at the two ring-shaped scraping parts 21 and 22 so as to seal the junction between the head tubular body 1 and the rear tubular body 2. Preferably, the scraping parts 21 and 22 are each designed to have an outer diameter slightly larger than the inner diameter of the head tubular body 1, so that the scraping parts 21 and 22 can be elastically stressed against the inner peripheral surface of the head tubular body 1 when the rear tubular body 2 is fitted in the head tubular body 1. The piston member 3 fundamentally comprises a cylinder having an outer diameter smaller than the inner diameter of the rear tubular body 2, and is provided with a ring-shaped scraping part 31 projecting outwardly from the front end portion and besides provided with another ring-shaped scraping part 32 projecting outwardly from the rear end portion. Furthermore, the front end of the piston member 3 is closed by an end wall 33, but the rear end is opened. Thus, the piston member 3 is slidable in its axial direction and is in contact with the inner peripheral surface of the rear tubular body 2 at the two ring-shaped scraping parts 31 and 32 so as to seal the junction between the rear tubular body 2 and the piston member 3 per se and define a chamber for containing a content between the end wall 11 of the head tubular body 1 and the end wall 33 of the piston member 3 per se. The rear tubular body 2 is provided with a stopping part 23 projecting inwardly from the front end, which prevents the piston member 3 from slipping off from the front end of the rear tubular body 2. Furthermore, a ring-shaped retention member 24 is attached to the rear end of the rear tubular body 2 in such a manner that the end portion of the rear tubular body is fitted in the retention member 24, and prevents the rear tubular body 2 from deforming by an external force and simultaneously prevents the piston member 3 from slipping off from the rear end of the rear tubular body 2.

The head tubular body 1, the rear tubular body 2 and the piston member 3 may be made of any materials, and they can be easily made, with high precision, of plastics such as polypropylene (PP), high-density polyethylene (HDPE), polyethylene terephthalate (PET), polycarbonate (PC) and nylon by molding methods such as injection molding. The scraping parts 21, 22, 31 and 32 are preferably made of a material of high flexibility, and when they are made by molding plastics, they are advantageously made of high-density polyethylene (HDPE) or the like. Moreover, it is further preferred to consider solvent resistance, barrier property, slipperiness and the like in selecting the material. The shape of the head tubular body 1, the rear tubular body 2 and the piston member 3 is not limited to the cylindrical shape and may be any of ellipse, polygon with round edges and others, but the cylindrical shape is preferred because the movement of the scraping parts is stable.

Next, motion of the volume reduction container of the present invention will be explained referring to FIG. 1 to FIG. 3. When the container is filled with the content, as shown in FIG. 1, the piston member 3 is positioned in a rear portion of the rear tubular body 2, and the scraping parts 21 and 22 of the rear tubular body 2 are positioned in a rear portion of the head tubular body 1. When the content is discharged from the outlet 12 by a pump or the like, the piston member 3 slides frontward in the rear tubular body 2 with scraping the content which adheres to the inner wall of the rear tubular body 2 by the scraping parts 31 and 32, and finally the scraping part 31 contacts with the stopping part 23 of the rear tubular body 2, as shown in FIG. 2. Thereafter, when the content is further discharged, the piston member 3 moves forward together with the rear tubular body 2, and in this case, the rear tubular body 2 slides frontward in the head tubular body 1 with scraping the content which adheres to the inner wall of the head tubular body 1 by the scraping parts 21 and 22, and finally the scraping part 21 contacts with the end wall 11 and the rear tubular body 2 stops, as shown in FIG. 3. At this point of time, since the greater part of the rear tubular body 2 is received in the head tubular body 1, the size of the whole container, namely, the length, decreases and the container becomes compact and thus transportation of the container at the time of disposal can be performed easily. The above example shows a mode in which the piston member 3 is first moved forward and thereafter the rear tubular body 2 is moved forward together with the piston member 3, but it is also possible that the rear tubular body 2 is first moved forward and thereafter the piston member 3 is moved forward, and furthermore it is possible that the piston member 3 and the rear tubular body 2 are simultaneously moved forward. It is a matter of course that when a content is charged in the container, the content is poured from the outlet 12 in the state as shown in FIG. 3 to allow the container to reach the state as shown in FIG. 1 through the route reverse to the above-mentioned route. Moreover, in the above explanation, the discharging of the content is performed by sucking the content by a pump or the like, but the same operation can be performed by pushing the piston member 3 toward the outlet 12 from the rear end side.

Figure 4:
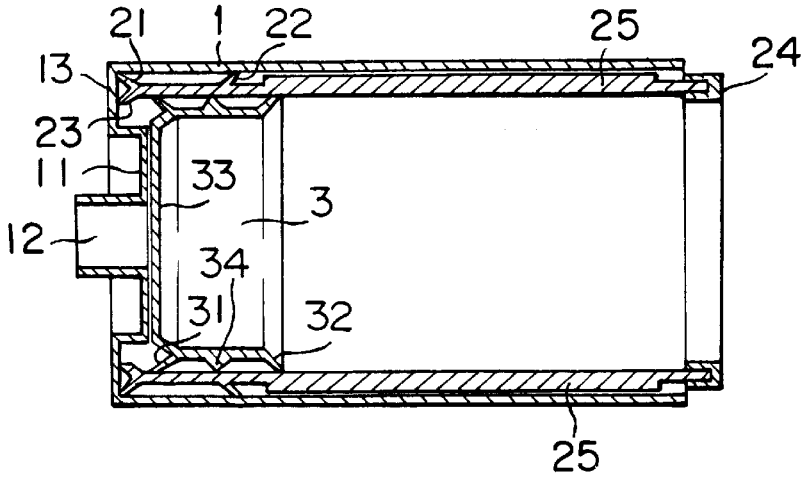
FIG. 4 is a side sectional view in a longitudinal direction of another example of the container of the present invention, showing it in a state after the content has been discharged.
Figure 7:
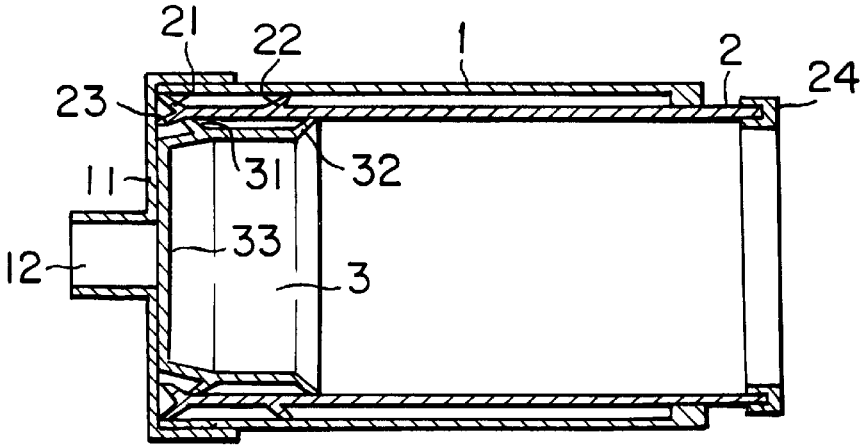
FIG. 7 is a side sectional view in a longitudinal direction of a modified example of the container of FIG. 4 in the same state as in FIG. 4.

In the example of FIG. 3, when the scraping part 21 of the rear tubular body 2 contacts with the end wall 11, there is formed a space between the end wall 33 of the piston member 3 and the end wall 11 of the head tubular body 1, and the content remains in the space and cannot be discharged. This is undesirable. Therefore, as shown in FIG. 4, the peripheral portion of the end wall 11 may be bent in the axial direction of the head tubular body 1 so that a ring-shaped dent portion 13 is formed. In this case, the scraping part 21 of the rear tubular body 2 is put in the dent portion 13, whereby the piston member 3 can move forward until it contacts with the end wall 11 and hence the whole content can be smoothly discharged. Alternatively, as shown in FIG. 7, the end wall 33 may be protruded beyond the scraping part 31 so that the end wall 33 of the piston member 3 can move up to the same plane as the tip of the scraping part 21 so as to allow the end wall 33 of the piston member 3 to nearly contact with the end wall 11 of the head tubular body 1 when the piston member 3 gets nearest the outlet 12. In this way, the space between the end wall 33 of the piston member 3 and the end wall 11 of the head tubular body 1 can be removed.

Figure 6:
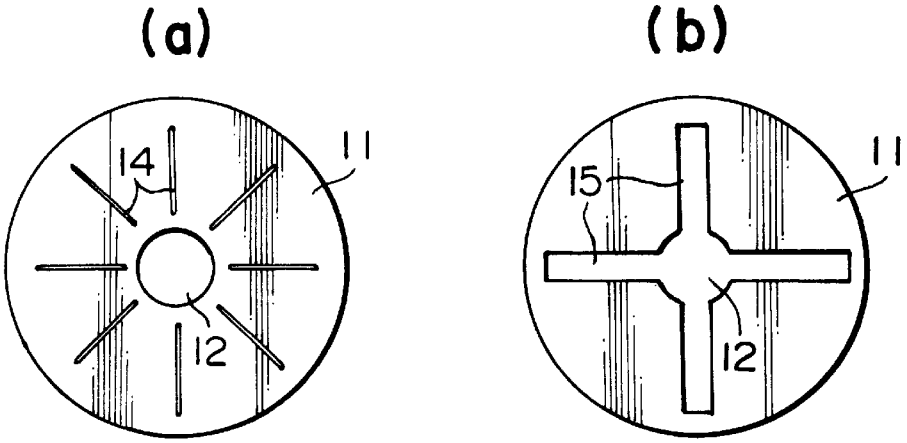
FIG. 6 is a sectional view taken along the line VI–VI' of FIG. 1.

Either in the case of forming the dent portion 13 or in the case of protruding the end wall 33, depending on the molding precision, both the end walls 11 and 33 do not always contact closely with each other and they sometimes contact with each other only at portions around the outlet 12, and thus there is a possibility of forming a slight space between them at the remaining portions. Therefore, as shown in FIG. 6, a plurality of projections 14 may be radiately arranged on the inner wall of the end wall 11 around the outlet 12 or a plurality of grooves 15 are radiately arranged communicating with the outlet, whereby ink can be guided to the outlet 12 and can be smoothly discharged to the last.

Furthermore, as in the example of FIG. 4, a spacer 25 which may be ribs protruding from the outer peripheral surface of the rear tubular body 2 toward the inner peripheral surface of the head tubular body 1 may be provided. In this case, the head tubular body 1 and the rear tubular body 2 are kept in parallel and the movement of the rear tubular body 2 is stabilized. The number of scraping parts 21, 22, 31 and 32 can be optional, and furthermore between the scraping parts 31 and 32, another scraping part 34 can also be provided as shown in FIG. 4, and similarly another scraping part (not shown) may be added to the outer peripheral surface of the rear tubular body 2.

Figure 5:
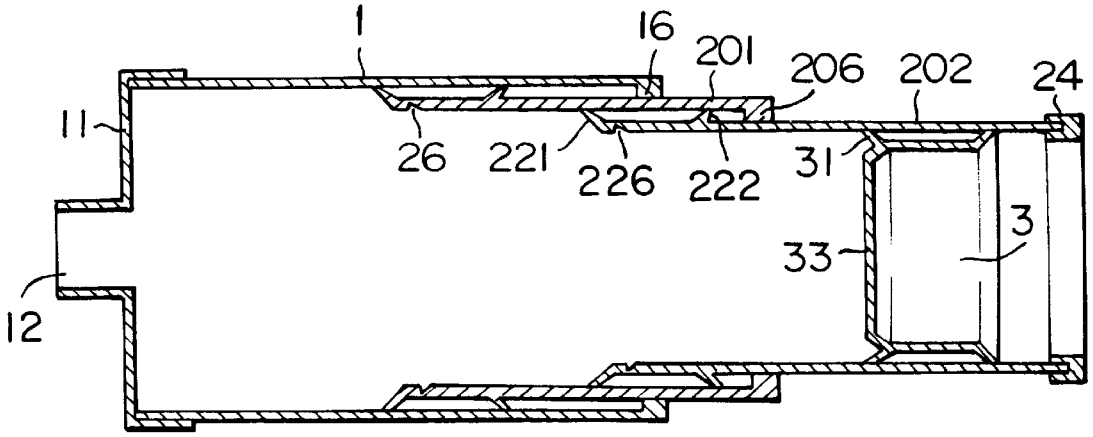
FIG. 5 is a side sectional view in a longitudinal direction of further another example of the container of the present invention, showing it in a state of a content being charged in the container.

In the present invention, the rear tubular body 2 can comprise a plurality of tubular bodies. As one example, the rear tubular body 2 comprising two tubular bodies is shown in FIG. 5. In the example of FIG. 5, the head tubular body 1 is the same as in FIG. 1. The rear tubular body comprises a tubular body 201 and another tubular body 202. The tubular body 201 is basically the same as the rear tubular body 2 in FIG. 1, but a claw 206 for the prevention of slipping off is provided instead of the retention member 24 and a ratchet type dent groove 26 is provided instead of the stopping part 23. Further, the tubular body 202 is the same as the tubular body 201 except that it has the retention member 24 and has an outer diameter smaller than the inner diameter of the tubular body 201, and is arranged contacting with the inner peripheral surface of the tubular body 201 at the ring-shaped scraping parts 221 and 222 so as to seal the junction between the tubular body 201 and the tubular body 202 per se and simultaneously arranged slidably in the axial direction of the tubular body 202. The piston member 3 is fitted in the tubular body 202 and is basically the same as in FIG. 1, except for having an outer diameter smaller than the inner diameter of the tubular body 202. The tubular body 201 and the tubular body 202 are joined by inserting the tubular body 202 into the tubular body 201 from the front end of the tubular body 201. In this case, the insertion of the scraping parts 221 and 222 of the tubular body 202 are not hindered by the ratchet type dent groove 26 of the tubular body 201, but at the time of discharging of the content, when the tubular body 202 moves toward the outlet 12, the scraping part 221 engages with the ratchet type dent groove 26 to prevent the tubular body 202 from slipping off in front of the tubular body 201. Similarly, the scraping part 31 of the piston member 3 engages with the ratchet type dent groove 226 of the tubular body 202 to prevent the piston 3 from slipping off in front of the tubular body 202. Accordingly, in the example of FIG. 5, with discharging the content from the outlet 12, the piston 3, the tubular body 202 and tubular body 201 gradually move forward to reduce the volume as in the example of FIG. 3.

Figure 8:
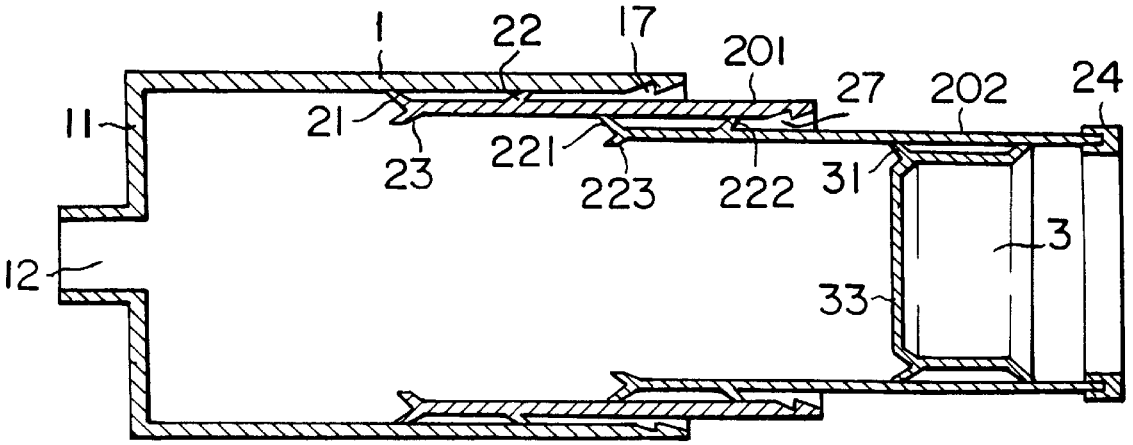
FIG. 8 is a side sectional view in a longitudinal direction of a modified example of the container of FIG. 5 in the same state as in FIG. 5.

FIG. 8 shows a modification of the example of FIG. 5. The example of FIG. 8 differs from that of FIG. 5 in that the head tubular body 1 comprises the end wall 11 and the cylindrical body which are integrally molded, and a ratchet type dent groove 17 is provided at the rear portion of the inner peripheral surface in place of the claw 16 for the prevention of slipping off. It is the same as the example of FIG. 5 in that the rear tubular body comprises tubular body 201 and tubular body 202, but differs in that the tubular body 201 and the tubular body 202 are respectively provided with stopping part 23 and stopping part 223 as in the rear tubular body 2 of FIG. 1, and furthermore, the tubular body 201 is provided with a ratchet type dent groove 27 at the rear portion of the inner peripheral surface. The tubular body 201 and the tubular body 202 are joined by inserting from the rear ends of the head tubular body 1 and the tubular body 201, respectively. In this case, insertion of the scraping parts 21 and 221 of the tubular bodies 201 and 202 is not hindered by the ratchet type dent grooves 17 and 27 of the head tubular body 1 and the tubular body 201, respectively, but they are prevented from coming out by engaging with the ratchet type dent grooves 17 and 27. Although not shown, it is possible to prevent the piston member 3 from coming off by providing the similar ratchet type dent grooves at the rear portion of the inner peripheral surface of the tubular body 202.

It is clear in the present invention that in the same manner as shown in FIG. 5 and FIG. 8, the rear tubular body can comprise 3 or more tubular bodies arranged in the telescopic manner. In any cases, the piston member 3 can be fitted in the last or rearmost tubular body.

According to the present invention, in a cylinder/piston type container, the cylinder comprises a head tubular body and a rear tubular body provided in telescopic manner. Therefore, there is provided a telescopic container which extends when the content is charged and contracts when no content is contained. Thus, the present invention contributes to reduction of the space occupied by the container before charging and after use at the time of storing and transportation thereof.

What is claimed is:

1. A container which comprises a head tubular body having an end which is closed by an end wall having an outlet for content, a rear tubular body which is fitted in said head tubular body and movable in an axial direction of said head tubular body, and a piston member which is fitted in said rear tubular body and movable in an axial direction of said rear tubular body, wherein said rear tubular body is provided with a retention member in fitting manner at an end remote from said head tubular body.

2. A container which comprises a head tubular body having an end which is closed by an end wall having an outlet for content, a rear tubular body which is fitted in said head tubular body and movable in an axial direction of said head tubular body, and a piston member which is fitted in said rear tubular body and movable in an axial direction of said rear tubular body, wherein said rear tubular body comprises a plurality of tubular bodies which are nested in a telescopic manner and movable in an axial direction of the tubular bodies, said piston member being provided in a tubular body positioned remotest from said head tubular body.

3. A container according to claim 1, wherein said rear tubular body and said piston member are respectively fitted in said head tubular body and said rear tubular body by means of a scraping member provided on an outer peripheral surface of each of said rear tubular body and said piston member.

4. A container according to claim 1, wherein the head tubular body, the rear tubular body and the piston member are cylindrical.

5. A container which comprises a head tubular body having an end which is closed by an end wall having an outlet for content, a rear tubular body which is fitted in said head tubular body and movable in an axial direction of said head tubular body, and a piston member which is fitted in said rear tubular body and movable in an axial direction of said rear tubular body, wherein said rear tubular body and said piston member are respectively fitted in said head tubular body and said rear tubular body by means of a scraping member provided on an outer peripheral surface of each of said rear tubular body and said piston member, and said rear tubular body is provided on an outer peripheral surface thereof with a spacer which protrudes toward an inner peripheral surface of said head tubular body.

6. A container which comprises a head tubular body having an end which is closed by an end wall having an outlet for content, a rear tubular body which is fitted in said head tubular body and movable in an axial direction of said head tubular body, and a piston member which is fitted in said rear tubular body and movable in an axial direction of said rear tubular body, wherein said end wall of said head tubular body has an inner wall provided with a ring-shaped dent portion so as to receive an end portion of said rear tubular body.

7. A container which comprises a head tubular body having an end which is closed by an end wall having an outlet for content, a rear tubular body which is fitted in said head tubular body and movable in an axial direction of said head tubular body, and a piston member which is fitted in said rear tubular body and movable in an axial direction of said rear tubular body, wherein said head tubular body, said rear tubular body and said piston define a single space that can be reduced in its volume.

8. A volume reduction container according to claim 7, wherein said rear tubular body is provided with a retention member in a fitting manner at and in remote from said head tubular body.

9. An ink container adapted for stencil printing ink comprising:

a head tubular body having an end which is closed by an end wall having an outlet, a rear tubular body which is fitted within said head tubular body, said rear tubular body being movable in an axial direction relative to said head tubular body, said rear tubular body including an end which is remote from said head tubular body, said end including a retention member, and a piston member which is fitted within said rear tubular body and which is movable in an axial direction relative to said rear tubular body, whereby said retention member prevents said piston member from disengaging from said rear tubular body at said end remote from said head tubular body.

* * * * *